United States Patent [19]

Schlack et al.

[11] Patent Number: 4,468,588

[45] Date of Patent: Aug. 28, 1984

[54] CATHODE SUPPORT STRUCTURE FOR AN IN-LINE ELECTRON GUN ASSEMBLY

[75] Inventors: Richard E. Schlack, Lititz; Kenny S. Richard, Ephrata, both of Pa.

[73] Assignee: RCA Corporation, New York, N.Y.

[21] Appl. No.: 347,525

[22] Filed: Feb. 10, 1982

[51] Int. Cl.[3] ..... H01J 29/50; H01J 29/46

[52] U.S. Cl. ..... 313/417; 313/447; 313/456; 313/457; 313/409

[58] Field of Search ..... 313/417, 409, 447, 456, 313/457

[56] References Cited

U.S. PATENT DOCUMENTS

| | | | |
|---|---|---|---|
| 3,873,879 | 3/1975 | Hughes | 315/13 |
| 3,974,416 | 8/1976 | van der Goot et al. | 313/417 |
| 4,063,128 | 12/1977 | Hughes | 313/409 |
| 4,071,803 | 1/1978 | Takanashi et al. | 313/409 |
| 4,138,624 | 2/1979 | Srowig | 313/417 |

FOREIGN PATENT DOCUMENTS

| | | | |
|---|---|---|---|
| 0019249 | 11/1980 | European Pat. Off. | 313/456 |

*Primary Examiner*—Eugene R. LaRoche
*Assistant Examiner*—Vincent De Luca
*Attorney, Agent, or Firm*—Eugene M. Whitacre; Dennis H. Irlbeck; Vincent J. Coughlin, Jr.

[57] ABSTRACT

An in-line electron gun assembly for a color television picture tube has a control grid and a center cathode disposed between two outer cathodes. The control grid and the cathodes are secured to a pair of insulating support rods. Each cathode is supported by a cathode support assembly comprising a cathode eyelet and a beading support member. Each beading support member varies in dimensions as a function of temperature and the center beading support member stabilizes at a higher operating temperature than the outer beading support members. The ends of the beading support members are embedded in a pair of oppositely-disposed insulating support rods. The center beading support member is formed of a material having a high thermal expansion coefficient and the outer beading support members are formed of a material having a lower thermal expansion coefficient. The materials are chosen such that the outer beading support members expand less than the center beading support member but substantially equal to one another so that the cathodes are rigidly affixed to the support rods. The expansion of the center beading support member exerts a force on the support rods that is sufficient to maintain tension on the control grid to prevent the control grid from moving during warmup.

6 Claims, 5 Drawing Figures

CATHODE SUPPORT STRUCTURE FOR AN IN-LINE ELECTRON GUN ASSEMBLY

BACKGROUND OF THE INVENTION

The invention relates to electron gun assemblies and more particularly to in-line electron gun assemblies of the type used in color television picture tubes.

U.S. Pat. No. 4,063,128 issued to R. H. Hughes on Dec. 13, 1977 discloses a structure for maintaining the equality of expansion in time and magnitude of the cathode-to-control grid (also referred to as the G1 grid) spacing in an in-line electron gun assembly in order to provide simultaneous cutoff of the electron beam currents for black level adjustment. In the Hughes patent, assigned to the same assignee as the present invention and incorporated herein for disclosure purposes, the cathode structure comprises three separate cathode assemblies disposed in a plane. Each of the cathode assemblies comprises a cathode sleeve closed at one end with an electron emissive coating disposed on the closed end portion of the sleeve. A filament is mounted within each of the sleeves. The sleeves are attached to cathode eyelets which are affixed to beading support members embedded into a pair of oppositely-disposed glass support rods. The outer support members are formed of 0.51 mm thick material to provide structural rigidity while the center support member is formed of 0.25 mm thick material to permit adequate spacing between the center and outer cathode assemblies. The thicker outer support members provide a better path for conducting heat away from the cathode filaments than does the thinner center support member. Consequently, when thermal equilibrium is achieved at approximately 15 minutes after filament activation, the center cathode assembly is operating at a higher temperature than the outer cathode assemblies. In other words, the temperature rise during warmup is greater for the center cathode assembly than for the outer cathode assemblies. To compensate for the temperature differences among the cathode assemblies, Hughes makes the outer cathode eyelets of a material having a higher thermal expansion coefficient than the material used to make the center cathode eyelet. This permits the outer eyelets to expand at substantially the same rate as the center cathode eyelet, thereby maintaining the change in cathode to G1 grid spacing substantially equal from gun to gun. In the Hughes patent, the center eyelet is constructed of type 52 metal while the outer eyelets are formed of type 305 stainless steel. The material used for all the beading support members in the Hughes structure is type 305 stainless steel.

While the structure disclosed in the Hughes patent provides satisfactory simultaneous cutoff of the beam currents for black level adjustment, the color tracking of the outer beams, i.e., "blue-red tracking", is occasionally a problem. While the cathode sleeves and cathode eyelets expand along the electron beam axis, i.e., along the Z-axis in a manner predicted by the Hughes patent, the color tracking problem appears to be related, to a significant extent, to nonuniform stressing of the cathode support members along the X-Y axis during warmup.

U.S. patent application Ser. No. 326,348, filed on Dec. 1, 1981 by M. K. Brown et al. and assigned to the same assignee as the present invention, discloses a cathode support assembly in which the stresses of the beading support members are equalized along the X-Y axis.

More specifically, the two outer support members are formed from type 52 metal having a thermal expansion coefficient between about 9.6 to about 10.1 microns per meter per degree centrigrade and the center support member is formed from type 42 metal having a thermal expansion coefficient between about 4.0 to about 4.7 microns per meter per degree centigrade. In this structure, the outer beading support members expand more than the center beading support member but substantially equal to one another so that the cathode assembly is rigidly affixed to the glass support rods.

While the Hughes structure and the Brown et al. structure generally improves the performance of the in-line electron gun, the relatively low expansion support members of the cathode assemblies of the Brown et al. structure introduce a thermal stress problem into the electron gun assemblies that affects the control grid electrode G1. FIG. 3 shows a graph of cathode current versus minutes warmup for the three electron guns of the Hughes structure. While the cathode currents for the three electron guns vary somewhat during the first several minutes of warmup, the cathode currents are not excessive and the major drawback of the Hughes structure, in addition to the aforementioned "blue-red tracking" problem, is that it takes about 7.5 minutes of warmup for the cathode currents to differ by about 2 miroamperes or less. In the Brown et al. structure, the cathode-to-control grid spacing is greatly influenced by the different materials of the support members. It has been determined that in the Brown et al. structure, the plane of the control grid, G1, moves away from the cathodes as the electron gun elements approach thermal equilibrium. Accordingly, to achieve the desired cathode-to-control grid spacing at operating temperature, the room temperature cathode-to-control grid spacing must be reduced. This reduction in cathode-to-control grid spacing at room temperature in the Brown et al. Structure results, as shown in FIG. 4, in excessive cathode current for all three electron guns for about the initial 4.5 minutes of operation after which the cathode currents reach an acceptable value of less than about 12 microamperes of current and the variation between the three electron guns is about 2 microamperes or less.

SUMMARY OF THE INVENTION

An electron gun assembly includes a control grid, a center cathode disposed between two outer cathodes, and a pair of insulating support rods for supporting the control grid and the cathodes. Each of the cathodes is supported by a cathode eyelet and a beading support member which varies in dimensions as a function of temperature. The beading support members have opposed ends which are embedded in the support rods. The improvement comprises means for maintaining the temperature dependent variations in dimensions of the outer beading support members substantially equal to one another and less than the temperature dependent variations in dimensions of the center beading support member. Such a structure rigidly affixes the cathodes to the support rods and also utilizes the temperature dependent variations in the support members to restrict the temperature dependent movement of the control grid relative to the cathodes.

BRIEF DESCRIPTION OF THE DRAWINGS

FIG. 3 is a graph showing a plot of cathode current versus minutes warmup for three prior art electron guns supported by three beading support members each formed of a material having a high thermal expansion coefficient.

FIG. 4 is a graph showing a plot of cathode current versus minutes warmup for three prior art electron guns supported by three beading support members, the outer two of which are formed of a material having a higher thermal expansion coefficient than the material of the center support member.

FIG. 5 is a graph showing a plot of cathode current versus minutes warmup for three electron guns having novel beading support members.

DETAILED DESCRIPTION OF THE PREFERRED EMBODIMENT

Figures 1, 2:
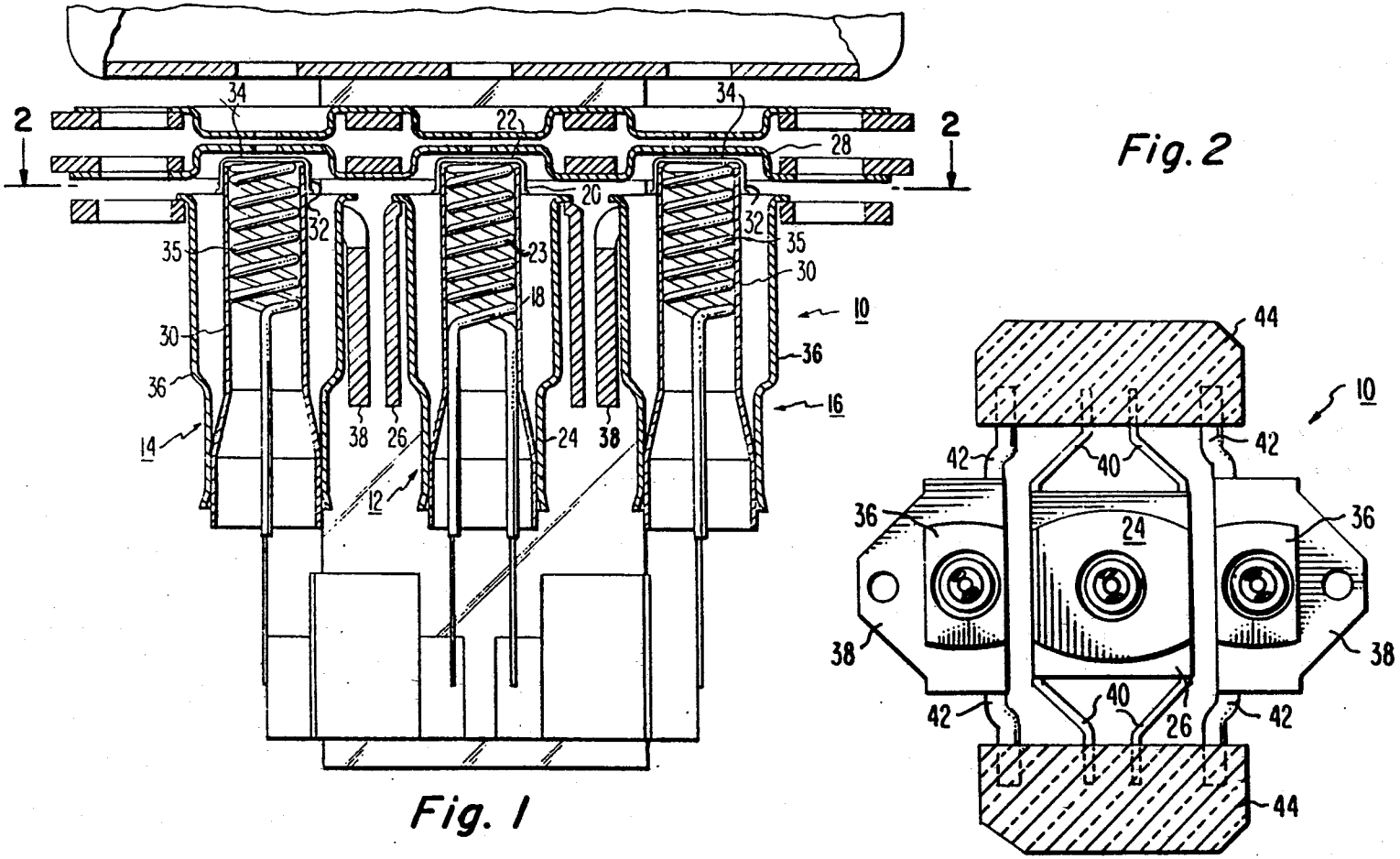
FIG. 1 is a sectional view of a portion of an in-line electron gun assembly.
FIG. 2 is a sectional view taken along lines 2—2 of FIG. 1.

In FIG. 1 there is shown a portion of an electron gun assembly 10 of a type used in color television picture tubes. Except for different materials used, the prior art electron gun assembly and the electron gun assembly featuring temperature compensation in accordance with the present invention utilize the same structure; consequently, the detailed description of the structure depicted in FIG. 1 is applicable to both.

The electron gun assembly 10 comprises a center cathode assembly 12, a first outer cathode assembly 14, and a second outer cathode assembly 16. The center cathode assembly 12 comprises a cathode sleeve 18 closed at the forward end by a cap 20 having an end coating 22 of an electron emissive material thereon. A filament 23 is mounted within the cathode sleeve 18. The electron emissive coating 22 is supported at a predetermined spacing from the aperture plane of a G1 grid 28 (also referred to as the control grid) by a center cathode eyelet 24 which is attached to the cathode sleeve 18 as well as to a fixed center cathode beading support member 26. This predetermined spacing is established during fabrication and is approximately equal to 0.13 mm.

Similarly, the first and second outer cathode assemblies 14 and 16 each comprise a cathode sleeve 30 closed at the forward end by a cap 32 having an end coating 34 of an electron emissive material thereon. A filament 35 is mounted within each cathode sleeve 30. The electron emissive coatings 34 are each maintained at a predetermined spacing from the G1 grid 28 by a cathode eyelet 36 which is attached to the cathode sleeve 30 as well as to a fixed outer cathode bearing support member 38. The predetermined spacings of the outer cathode assemblies are also established during fabrication and are substantially equal to the spacing of the center cathode assembly, which is approximately 0.13 mm.

WARMUP OF PRIOR ART GUNS

In the prior art structure, such as that disclosed in U.S. Pat. No. 4,063,1288 to Hughes, referenced above, the center cathode eyelet 24 is preferably constructed of type 52 metal, having a thermal expansion coefficient of about 9.5 microns per meter per degree centigrade. The preferred material for the outer eyelets 36 is type 305 stainless steel, having a thermal expansion coefficient of about 20 microns per meter per degree centigrade. The center cathode beading support member 26 and the outer cathode beading support members 38 are formed of type 305 stainless steel. The center support member 26 has a thickness of 0.25 mm and the outer support members 38 have a thickness of 0.51 mm. The G1 grid 28 is preferably constructed of type 305 stainless steel. This selection of materials assured that the variations in cathode-to-grid spacing due to temperature changes during warmup were kept substantially equal from cathode to cathode.

As shown in FIG. 2, the center cathode support member 26 has a pair of center beading projections 40 extending outwardly from opposite ends thereof. The center projections 40 are integral with the center support member 26. The outer cathode support members 38 also include integral outer beading projections 42 extending outwardly from the opposite ends of the support members. The beading projections 40 and 42 are embedded into a pair of oppositely-disposed glass support rods 44. The support rods 44 and the procedure for performing the beading operation are described in copending U.S. patent application Ser. No. 258,740 filed on Apr. 29, 1981 by J. R. Hale, assigned to the assignee of the present application and incorporated herein for the purpose of disclosure. In the Hughes electron gun structure, in which the center cathode support member 26 and the outer cathode support members 38 are formed of type 305 stainless steel, the center beading projections 40 expand slightly more during warmup than the outer beading projections 42 since the temperature of the center cathode assembly is higher than the outer cathode assemblies. In the ideal electron gun assembly in which the beading projections 40 and 42 are equally embedded into the support rods 44, the slightly increased expansion of the center beading projection 40 is compensated by the difference in material thickness between the center support member and the outer support members so that the forces due to the support member acting on the support rods 44 are substantially equal. However, in a small percentage of electron guns, if the outer beading projectons 42 of one of the outer support members 38 are incompletely embedded or are misaligned within the support rods 44, nonuniform stress is produced within the electron gun assembly 10. The nonuniform stress generally causes movement in one of the outer cathode assemblies relative to the other outer cathode assembly so that the blue and red-producing electron beams do not track properly and the cathode current varies from cathode to cathode.

To correct the blue-red tracking problem incurred during warmup, the outer cathode support members 38 may be made of a material having a higher thermal expansion coefficient than the material used to make the center cathode support member 26. Such a structure is discussed in the copending U.S. patent application Ser. No. 326,348 filed on Dec. 1, 1981 by M. K. Brown et al. In the Brown et al. structure, the thermal expansion coefficient of the outer cathode support member 38 is selected to be lower than the thermal expansion coefficient of the outer cathode eyelets 36 which are attached to the outer support members 38. Furthermore, the ratio of the thermal expansion coefficients of the outer support members 38 to the center support member 26 must be such that the outer beading projections 42 expand more than the center beading projections 40 so that the support rods 44 exert a tension on the center projections 40. In other words, a push-pull cathode support structure is required in order to provide proper color tracking during warmup. In the Brown et al. structure, the outer beading projections 42 exert a sufficient outward force on the support rods 44 to keep the center beading projections 40 in tension over the operating temperature range of the electron gun. Even in electron gun assemblies in which the outer beading projections 42 are somewhat misaligned or not completely embedded within the support rods 44, the expansion of the outer beading projections 42 will be substantially equal to one another and greater than the expansion of the center beading projections 40 despite the higher operating temperature of the center cathode assembly and the correspondingly higher temperature of the center support member 26. This structure will provide a "rigid-box" that will prevent movement of one of the outer cathode assemblies relative to the other outer cathode assembly.

In the Brown et al. structure, the center cathode support member 26 is constructed of type 42 metal, having a thermal expansion coefficient within the range of about 4.0 to 4.7 microns per meter per degree centigrade. The outer cathode support members 38 are constructed of type 52 metal, having a thermal expansion coefficient within the range of about 9.6 to 10.1 microns per meter per degree centigrade. While the Brown et al. structure eliminates the "blue-red tracking" problem inherent in the Hughes structure, the Brown et al. structure, which utilized low expansion support members, does not transfer sufficient force to the support rods 44 to maintain the G1 control grid 28 in tension during warmup. Thus, the control grid 28 moves away from the cathodes until equilibrium is achieved. To compensate for this problem, the cathode-to-control grid spacing at room temperature is decreased to permit for expansion during operation. The resultant cathode current surge or overshoot which approaches 60 microamperes is shown in FIG. 4.

Warmup of the Present Novel Guns

To correct the cathode current surge during warmup, the outer cathode support members 38 are made of a material having a lower thermal coefficient than the material used to make the center cathode support member 26. The thermal expansion coefficient of the center support member 26 must be such that the center beading projections 40 expand against the support rods 44 placing the center beading projections 40 in compression and exerting a tension on the outer beading projections 42 which expand equal to one another but less than the center projections. As long as the outer beading projections 42 are securely embedded within the support rods 44, the structure will provide a "rigid-box" similar to that provided by the Brown et al. structure; however, unlike the Brown et al. structure, the forces transferred by the beading projections 40 and 42 to the support rods 44 and to the control grid 28 are sufficient to keep the control grid 28 sufficiently in tension to prevent or minimize the motion of the aperture plane of the grid along the electron beam axis of the gun. As shown in FIG. 5, the cathode current surge of the present structure is considerably less than that of the Brown et al. structure, within the first few minutes of warmup, and reaches an acceptable operating level within 3.5 minutes.

In the present novel structure, the center cathode support 26 is constructed of type 305 stainless steel, having a thermal expansion coefficient within the range of about 17 to about 20 microns per meter per degree centigrade. The outer cathode support members 38 are constructed of type 52 metal having a thermal expansion coefficient within the range of about 9.6 to about 10.1 microns per meter per degree centigrade. The novel cathode support structure simultaneously corrects the "red-blue tracking" problem by keeping both outer supports in equal tension, and the cathode current surge problem by preventing the movement of the control grid 28 during warmup, thus permitting the room temperature cathode-to-cathode grid spacing to be set at the desired operating temperature spacing.

What is claimed is:

1. In an electron gun assembly having a control grid, a center cathode disposed between two outer cathodes, and a pair of insulating support rods for supporting said control grid and said cathodes, each of said cathodes being supported by a cathode eyelet and a beading support member, wherein each of said beading support members varies in dimensions as a function of temperature, each of said beading support members having opposed ends which are embedded in said pair of support rods, the improvement comprising means for maintaining said temperature dependent variations in dimensions of said outer beading support members substantially equal to one another and less than the temperature dependent variations in dimensions of said center beading support member thereby rigidly affixing said cathodes to said support rods, and for utilizing said temperature dependent variations in said support members to cause said support rods to apply tension to said control grid so as to restrict the temperature dependent movement of said control grid relative to said cathodes.

2. In an electron gun assembly having a longitudinally-extending gun axis, a pair of oppositely-disposed insulating support rods substantially parallel to said axis, a control grid and a plurality of cathode assemblies, said control grid and said cathode assemblies being affixed to said support rods, said cathode assemblies being spaced from said control grid and comprising a center cathode assembly disposed between two outer cathode assemblies, each of said cathode assemblies comprising a cathode being supported by a cathode eyelet and a beading support member, wherein each of said beading support members varies in dimensions as a function of temperature and the center beading support member stabilizes at a higher operating temperature than said outer beading support members, each of said beading support members having opposed ends which are embedded in said insulating support rods, the improvement comprising means for maintaining said temperature dependent variations in dimensions of said outer beading support members substantially equal to one another and less than the temperature dependent variations in dimensions of said center beading support members whereby said center beading support member expands more than said outer beading support members as a function of temperature and for utilizing said temperature dependent variations in said support members to cause said support rods to apply tension to said control grid so as to restrict the temperature dependent movement of the control grid along said gun axis.

3. An electron gun assembly in accordance with claims 1 or 2 wherein said means for maintaining and utilizing includes said center beading support member having a greater thermal expansion coefficient than the outer beading support members such that the expansion of said center support member is substantially greater than that of the outer support members and the expansion of said outer support members being substantially equal to one another over the operating temperature range of said electron gun assembly.

4. An electron gun assembly in accordance with claim 3 wherein said center beading support is formed of a material having a thermal expansion coefficient of between about 17 to about 20 microns per meter per degree centrigrade and said outer beading support members are formed of a material having a thermal expansion coefficient of between about 9.6 to about 10.1 microns per meter per degree centigrade.

5. An electron gun assembly in accordance with claim 4 wherein said center beading support member is formed of type 305 stainless steel and outer beading support members are formed of type 52 metal.

6. In an electron gun assembly for a color television picture tube comprising a plurality of cathode assemblies, including a center cathode diposed between two outer cathodes, and a control grid, said cathode assemblies and said control grid being secured to a pair of oppositely-disposed insulating support rods, each of said cathodes being supported by a cathode eyelet and a beading support member, wherein each of said beading support members varies in dimensions as a function of temperature and the center beading support member stabilizes at a higher operating temperature than the outer beading support members, each of said beading support members having opposed ends which are embedded in said support rods, the improvement wherein said center beading support member being formed of a material having a thermal expansion coefficient between about 17 to about 20 microns per meter per degree centigrade and said outer beading support members being formed from a material having a thermal expansion coefficient between about 9.6 to about 10.1 microns per meter per degree centigrade whereby said center beading support member expands more than said outer beading support members as a function of temperature thereby transferring through said support rods a resultant force which acts upon said control grid to restrict the temperature dependent movement of said control grid relative to said cathodes so as to minimize the cathode surge currents during warmup.

* * * * *

UNITED STATES PATENT AND TRADEMARK OFFICE

CERTIFICATE OF CORRECTION

PATENT NO. : 4,468,588

DATED : August 28, 1984

INVENTOR(S) : Richard Evan Schlack et al.

It is certified that error appears in the above—identified patent and that said Letters Patent is hereby corrected as shown below:

Column 2, Line 27 - "miroamperes" should be -- microamperes -- ;

Column 3, Line 51 - "bearing" should be -- beading -- ;

Column 4, Line 38 - "projectons" should be -- projections -- ; and

Column 7, Line 11 - before "outer" insert -- said -- .

Signed and Sealed this

Second Day of April 1985

[SEAL]

Attest:

DONALD J. QUIGG

Attesting Officer

Acting Commissioner of Patents and Trademarks